US005934214A

United States Patent [19]

Ketterer

[11] Patent Number: 5,934,214

[45] Date of Patent: Aug. 10, 1999

[54] METHOD OF SAILING A BOAT, AND SAILING VESSEL

[76] Inventor: Klaus Ketterer, Maurenbrecherstrasse 18, Krefeld D-47803, Germany

[21] Appl. No.: 09/000,458

[22] PCT Filed: Jul. 31, 1996

[86] PCT No.: PCT/DE96/01424

§ 371 Date: Jan. 28, 1998

§ 102(e) Date: Jan. 28, 1998

[87] PCT Pub. No.: WO97/06051

PCT Pub. Date: Feb. 20, 1997

[30] Foreign Application Priority Data

Aug. 4, 1995 [DE] Germany ..... 195 28 796

[51] Int. Cl.[6] ..... B63B 35/00

[52] U.S. Cl. ..... 114/39.11; 114/39.21; 114/143; 114/103

[58] Field of Search ..... 114/39.11, 39.21, 114/102, 140, 103, 141, 143

[56] References Cited

U.S. PATENT DOCUMENTS

| | | | |
|---|---|---|---|
| 3,968,765 | 7/1976 | Menegus . | |
| 4,044,703 | 8/1977 | Kurtz | 114/143 |
| 4,817,550 | 4/1989 | Gutsche | 114/143 |
| 5,152,238 | 10/1992 | Page | 114/143 |

FOREIGN PATENT DOCUMENTS

| | | |
|---|---|---|
| 293226 | 8/1913 | Germany . |
| 376152 | 6/1920 | Germany . |
| 3531994 | 3/1987 | Germany . |
| 7801749 | 8/1979 | Netherlands . |

*Primary Examiner*—Stephen Avila
*Attorney, Agent, or Firm*—James Creighton Wray; Meera P. Narasimhan

[57] ABSTRACT

A sailing method and a sailing boat (1) are designed for low or even non-drift sailing, wherein the total power provided by the sail (5) is established, after which the keel (3) is adjusted in terms of its effective surface and/or its curvature and/or the shape of its profile and/or its setting angle in relation to the boat's hull, possibly taking into account the water current and the weight of the boat, in order to produce an optimized counteracting force. To this end the keel (3) is designed as a multi-section, unballasted fin keel (33) which can be completely retracted into the boat's hull (2) and can be pivoted relative to the centerline of the boat (10), and the sections (34, 37, 38) of which are fitted together via hinges (35, 39) in order to produce a variable curvature.

15 Claims, 5 Drawing Sheets

34
35
37
36
40
3
39
38
10
33

34
37
3
38
33

34
37
33
38

34
37
39
38
33

METHOD OF SAILING A BOAT, AND SAILING VESSEL

This application is a 371 of PCT/DE96/01424 filed Jul. 31, 1996 which claims priority based upon a Fed Rep Germany application 19528796.7 filed Aug. 4, 1995.

BACKGROUND OF THE INVENTION

The invention involves a method for low or even non-drift sailing of a boat having a fin keel, with a sail that is mounted outside of the center-line plane and can be brought appropriately into the wind, wherein the entire rigging, including the horizontally and vertically pivotable mast arm and the sail, can be adjusted so as to generate optimum power, and can be locked in place in this position. The invention also involves a sailing vessel comprising a ship's hull having a retractable fin keel and a hinged, pivotable mast arm, and the sail that is mounted thereon.

In the history of sailing craft, especially involving sailing, a vessel's sail carrying ability has always been functionally dependent upon its stability. The power of the sails generated via the wind—when the wind comes from a side angle rather than directly from the rear—acts not only in the vessel's driving direction, but predominantly transverse to this. This would cause the ship to capsize if structural provisions to counter this, in the form of the "stability" of the boat, were not included. There are principally two means for accomplishing this, which are commonly used in combination with one another. In order to achieve so-called stability by weights, the vessel is provided with a sort of "counterweight," the ballast. This is mounted as low as possible on the boat. Most often the ballast hangs below, on the fin keel, which is rigid and firmly mounted onto the boat. When the wind pressure tilts, or heels, the boat to one side, a distance is created between the perpendicular lines of the weight of the ballast and the counteractive hydrostatic buoyancy, which acts as a lever arm for the ballast, creating a moment that counteracts the heeling. The effectiveness of this rigid-mounted ballast can be augmented by using a movable ballast, which is positioned each time on the side facing the wind, that is, windward. Very small boats are stabilized only with movable ballast, in that the crew members sit on the windward edge of the boat and lean outward. A further means of increasing stability involves widening the vessel itself. The most obvious example of this hydrostatic stability is a raft. In this case, the empty weight of the vessel acts in conjunction with its distance from the lateral "tilting edge" of the vessel. This is the manner in which all multiple-hulled craft, such as catamarans, trimarans, and boats having lateral floating or landing outriggers, achieve the stability necessary to compensate for the heeling momentum caused by the wind.

In order for a vessel to have the greatest possible potential for speed, it must be equipped with the largest possible sails. In addition to great propulsive power, however, large sails also generate an undesired, great transverse force, which, together with the lever arm, that is, the distance between the center of pressure of the sails and the lateral center of pressure, generates great heeling momentum. Thus, up to now, generating great counteracting momentum has required much ballast and/or a very broad boat. With today's keel yachts, the ratio of the ballast to the total weight often amounts to 50% (up to 80% with regatta boats). The ballast increases the displacement of the vessels, thereby wiping out a considerable share of the advantages that it creates. It also decreases the load carrying capacity, and it requires costly measures to mount it to the ship's hull, thus making the vessels more expensive. There are also considerable disadvantages to having very wide vessels. If, for example, a boat having a high degree of hydrostatic stability capsizes, it is often difficult to correct it.

One rigging design for watercraft, known in the art from DE-OS 42 38 786.8, makes it possible for the sail or sails to be mounted outside of the center-line plane, and to be positioned such that they tilt against the wind, wherein the sail is an isosceles triangular sail that is braced with one boom at its center, and that is fastened with its base line as a fore-leach rope in a yard that can be infinitely positioned and adjusted, and is mounted over a hinged, swiveling cantilever as the mast arm. With a boat or rigging design of this type it is possible to reduce somewhat the turning moment created by the power of the wind or by the sail. With proper positioning of the sail, the line of force can be guided through the height of the rotational or rolling axis of the boat, so that the total power of the sail has only a small lever arm, or even no lever arm at all, for heeling the boat. Finally, it is even possible to guide the line of force under the centerboard or under the keel at the height of the position of the lateral center point, so that the turning moment—created by the water power and the distance of the lateral center of pressure—is compensated for by the rotational axis. The keel, which serves as the bearing surface, requires a certain setting angle to generate buoyancy in the water. In current state-of-the-art constructions, in which the fin keel is permanently mounted to the ship's hull, this setting angle is automatically set such that the boat drifts, in other words, it does not sail in the direction of its center line. Currently, this drift angle is optimally adjusted only in rare cases. In any case, it is a disadvantage that the entire hull of the boat must be designed to coincide with this angle. Because it is permanently mounted to the boat's hull, the shape of the entire hull must agree with this setting angle, causing the sailboat to sail not along its center line, but rather diagonally to this line. This generates considerable resistance, and reduces the speed of the vessel.

It is thus the object of the invention to provide a method of sailing and a sailing vessel that will enable sailing without a heeling, turning moment, and without a tilting of the vessel.

SUMMARY OF THE INVENTION

The object is attained in accordance with the invention in that the total power provided by the sail is established, and in that then the fin keel, which is connected to the sail via a rotating platform and a mast arm, is adjusted, in terms of its effective area and/or its curvature and/or the shape of its profile and/or its setting angle, to agree with the positioning of the sail, such that the total power of the projection generated by the fin keel is geared to counteract precisely the total power of the sail on the horizontal plane, and at the same time the ratio of buoyancy to resistance of the fin keel is maximized, while the vessel's hull remains precisely in the sailing direction.

In this way it is possible to provide a sufficiently stable vessel, regardless of the size of the sail spread. Thus, to a considerable extent, the ballast and breadth of the vessel can be reduced. These sailing vessels will sail considerably faster under the same wind power, and they will sail upright, which offers considerable advantages in terms of comfort and safety. Due to the extreme reduction in the ballast it is also possible to free the keel from its former dual function—as fin and mounting for the ballast—and to design it such that it can pivot, and can be changed in terms of the shape of its profile, or can even be changed completely. In this manner any drifting is prevented, so that all of the sail power can be used to propel the vessel forward. Although attempts have been made in the past to use curvable keels, or even to design a keel that can pivot, these constructions were not successful since the rigidity required by the attached ballast resulted in a conflict of goals (DE-GM 82 11 104, DE-OS 32 48 580.8 and DE-OS 33 29 508.5). In addition, these known-in-the-art constructions have had neither the goal nor the means of operating in conjunction with the sailing forces of strength and course, and with the speed of the vessel, in order to steer the vessel.

In accordance with one development of the invention, the leading edge of the sail is always positioned at a right angle to the apparent wind, and the sail is set such that the line of force of the total power of the sail intersects the lateral plane below the lateral center of pressure, and/or extends forward or astern or to the side of the lateral plane. Based upon this embodiment of the sailing method, the sail can be brought into any position at any time that will enable the total power of the sail to be established, thus enabling the corresponding adjustment to the keel, with the necessary degree of certainty and according to a precisely predetermined pattern. In this manner, with the corresponding adjustment of the keel or the fin keel, a resulting force that precisely counters the total power of the sail can be developed, so that no turning moment affects the vessel during straight sailing at all, but in turning maneuvers, a turning moment, the magnitude of which can be adjusted, is created around the vertical axis, so that the sailing vessel can sail precisely in the direction of its center-line plane, even in the case of lateral winds.

A further development of the invention provides for the keel to be automatically adjusted, in terms of the size of its effective surface and/or its setting angle and/or the shape of its profile, to correspond with the power produced by the sail and with the relative speed of the current. This automatic operation has the advantage that all of the various components can be accounted for in each case, so that the optimum effect for the "driving" of the vessel is achieved.

For the implementation of the method, a vessel is provided, in which the keel is designed as a multi-section, unballasted fin keel, which can be completely retracted into the hull and pivoted in relation to the center-line plane of the boat, and the sections of which are fitted together via hinges to produce a variable curvature. With this type of vessel, or with a vessel having a keel of this design, it is possible to implement the above-described sailing method, and to achieve the thus attainable advantages. With the special design of the fin keel, a change or adjustment in both its curvature and the shape of its profile as a whole can be achieved. In addition, in accordance with this design, the fin keel as a whole can be pivoted, such that the setting angle relative to the current is correspondingly adjusted, and finally, the fin, as such, can be retracted into the vessel's hull if necessary, or can be lowered out of it, so that the effective surface can be adjusted to correspond to the measurements. Depending upon the circumstances, it may also be necessary, or may only be necessary, to change the shape of the profile of the fin keel; this is achieved in accordance with the invention in that the fin keel, as a whole or in its sections, is designed such that the shape of its profile can be adjusted. This is accomplished in that the sections of the fin keel can be expanded or shrunk in order to alter the shape of its profile to correspond to requirements.

Advantageously, the fin keel is mounted to the hull of the vessel or to the rotating platform such that it can pivot up to 90° to any side, allowing the vessel to move laterally in docking or casting off maneuvers. In addition, under extreme conditions, such as a hurricane, the effect of a large drag anchor can be created using one transverse and one lengthwise fin keel, especially if the lateral plane is equipped with two fin keels, as is further provided for in the invention, that can be lowered and retracted, pivoted, and adjusted in terms of profile shape and curvature independently of one another, and that are positioned along the center-line of the vessel, one in front of the other, wherein one of the two fin keels may be positioned in the center of the boat, but may also be positioned further toward the bow of the boat. The second fin keel is positioned below the engine if steerage is required or if, as mentioned above, under heavy waves the directional stability of the vessel is to be improved.

In accordance with a further advantageous design, the fin keel is designed to comprise three sections, wherein the center section contains the pivoting axis, and the tip of the profile and the rear fin section are mounted to the center section via hinges. This design makes it possible to create an asymmetrical profile to coordinate with the sail power, essentially without requiring any expenditure on construction. In addition, the individual sections of the fin keel may be connected to one another, for example via an outer shell, or they may be separate sections that are connected to one another via the hinges such that they can pivot correspondingly.

The advantageous full exploitation of the power from the sail, mentioned above, is made possible especially in that the mast arm is mounted via a flexible joint to the deck of the vessel such that it can pivot horizontally and vertically and can rotate around its longitudinal axis, and is designed such that its length can be adjusted and locked into any position. In this manner, the sail, as such, can be maneuvered in any position at all, even far beyond the hull of the vessel, with the positioning of the vessel's hull without drift being ensured via the alteration or adjustment of the fin keel, as mentioned above.

The design of that part of the sailing vessel that involves the sail can be further optimized if the head of the mast arm is fitted with a single-axis, lockable joint, to which the main boom is mounted via hinges; this main boom contains an internal pivoting shaft that can rotate around its longitudinal axis and can slide along its longitudinal axis, and is equipped with a heading containing gear works for operating the reef shafts that are held in the yard and take up the sail cloths. With this design, the actual sail can be brought into any position, and, as a result of the special design of the mast arm and the associated components of the rigging, the position can also be identified such that the necessary conclusions regarding the shape and position of the keel may be drawn.

A particularly advantageous form in terms of the purpose of the sail is achieved when outer booms are mounted to the yard via hinges such that they can be locked in place, and are equipped with guide pulleys. This provides the sail with a rectangular shape that is more favorable in terms of current.

As was indicated above, conclusions can be made regarding the total power of the sail by considering the positioning of the sail or the changes made to this positioning, thus allowing the fin keel to be adjusted accordingly. In order to permit the rapid determination of the necessary key values, each joint is equipped with an angle sensor.

Both for picking up the wind and for evaluating the corresponding key data it is advantageous for the yard that is designed as a profile tip to form, in conjunction with two sail cloths that can be rolled up into the yard, a "thick"

bearing surface, whose curvature and whose ratio of length to depth (breadth) can be adjusted.

The apparatus can be built at lower cost and more easily if one reef shaft holds two sail cloths, which are fastened to the trailing edge of the yard via a plate that has rounded edges and is positioned at right angles to the sail cloths. In this manner it is possible, when the sail is reefed, to maintain the desired profile thickness; further, it is advantageous if the sail cloths can be rolled up and rolled out separately, in order to permit the given wind conditions to be exploited to produce a desired level of power for the sailing boat.

The invention is characterized especially in that a method of operating a sailboat, and a sailing vessel for implementing this method, are provided, which will enable sailing without disadvantageous heeling turning moment, making it possible to keep the sailing vessel or the vessel's hull horizontal at all times, thus increasing substantially the comfort and the safety of a vessel of this type, while simultaneously enabling an optimum exploitation of the force exerted by the wind.

Thus, the dependent conditions that have been assumed up to now, according to which large sails may be used only if the boat is provided with an adequate degree of stability, are eliminated. It is possible to use any size of sails on a sailing boat (even if the boat possesses only a low degree of stability). In this manner, the load carrying capacity of the vessels can be increased while the total weight is reduced, so that on the whole, faster sailing vessels, and sailboats that are easier to steer, are possible.

Further details and advantages of the object of the invention are provided in the following description of the attached diagrams, in which a preferred exemplary embodiment with the necessary details and component parts are illustrated. These show:

DETAILED DESCRIPTION OF THE PREFERRED EMBODIMENT

Figure 1:
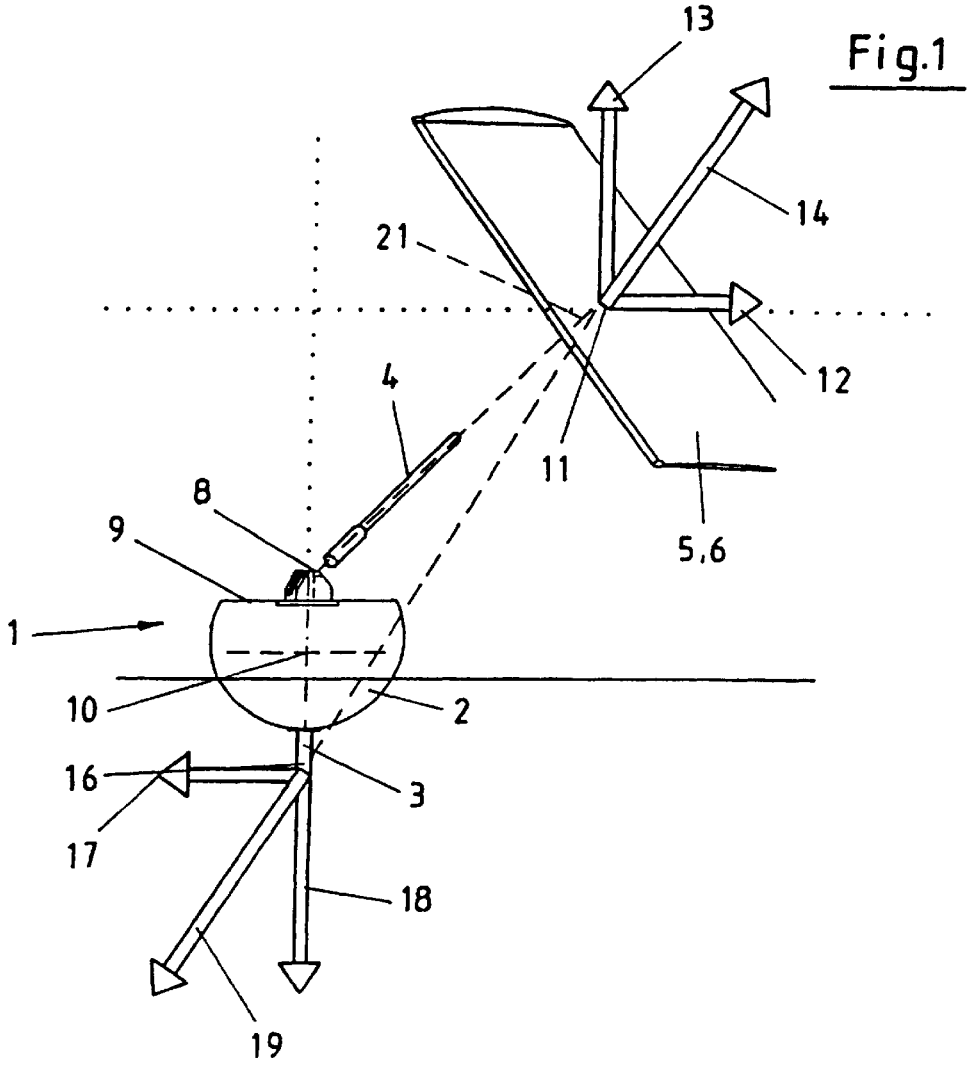
FIG. 1: a sailboat operated in accordance with methods specified in the invention.

FIG. 1 illustrates the principle of the method specified in the invention. The sailing boat 1 or the boat's hull 2 is shown here from the rear, wherein the keel 3 and the sail 5, which is mounted to the mast arm 4 such that it can pivot, with the sail cloth 6, are shown. The mast arm 4 pivots around a flexible joint 8, which is mounted on the deck of the boat 9. The mast arm 4 is merely sketched in outlines. Due to the special design of the mast arm 4, the sail 5 can, to some degree, also be shifted along the center line 10 of the boat.

The total power 14 generated by the sail 5, which acts upon the center of pressure of the sail 11, can be broken down into the transverse power of the sail 12 and the lifting power of the sail 13. The hydrodynamic transverse force 17 acts counter to the aerodynamic transverse force or the transverse force of the sail 12 at the lateral center of pressure 16. The gravitational weight of the boat's hull 2, which is not illustrated here, is ordinarily fully compensated for by the hydrostatic buoyancy in the water, also not illustrated here. Due to the fact, however, that the tilted sail 5 creates a lifting force 13, the boat's hull 2 is lifted somewhat, causing a portion of the total weight to act as a gravitational counter force or counterweight 18 to the lifting force 13. This part of the force of the weight 18, together with the hydrodynamic transverse force 8, forms a parallelogram of forces with the total power 19. The total power 14 and the total power 19 act counter to one another along the same line. Thus, no lever arm is created, which also allows no turning moment to form. The transverse forces 12 and 17—since they are formed in a single dynamic process—are not always of the same magnitude. With imbalances, in addition to linear accelerations, rotational accelerations occur, which is why it must also be possible, as mentioned above, to permit the line of total force of the sail 5 to extend below the lateral center of pressure 16 or even below the lateral plane.

Figure 2:
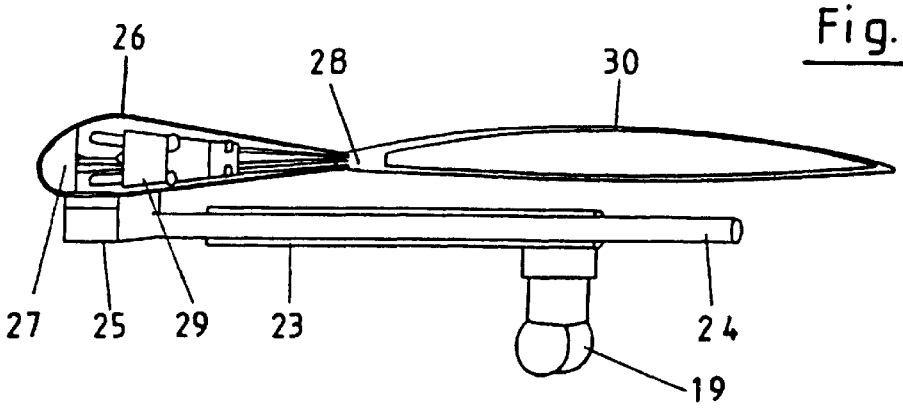
FIG. 2: a perspective view of a cross-section of the yard.

FIG. 2 shows a perspective view of a cross-section of the yard 26 and a lengthwise section of the main boom 23 with the pivoting shaft 13, which is positioned inside the main boom [23], can be shifted lengthwise along the main boom 23, and can be rotated within the main boom 23; and of the gear works 25 that operate the shaft 27 that is mounted on the yard 26, and can be used to rotate the reef shafts 29 via the ends 28 of the yard 26. The sail cloths 6 which are to be rolled up around the reef shafts 29 are not illustrated here. Also shown in this diagram is one of the two outer booms 30, which can be used to give the sail 5 a rectangular shape, and the single-axis joint 22, with which the setting angle of the sail 5 can be adjusted to the wind. The ability to move the pivoting shaft 24 along the longitudinal axis of the main boom 23 makes it possible to compensate for the shifting of the center of pressure of the sail or the lateral center of pressure 16 via various setting angles for the sail 5. The joint 22 is mounted at the top 21 of the mast arm 4.

Figures 3, 4, 5, 6:
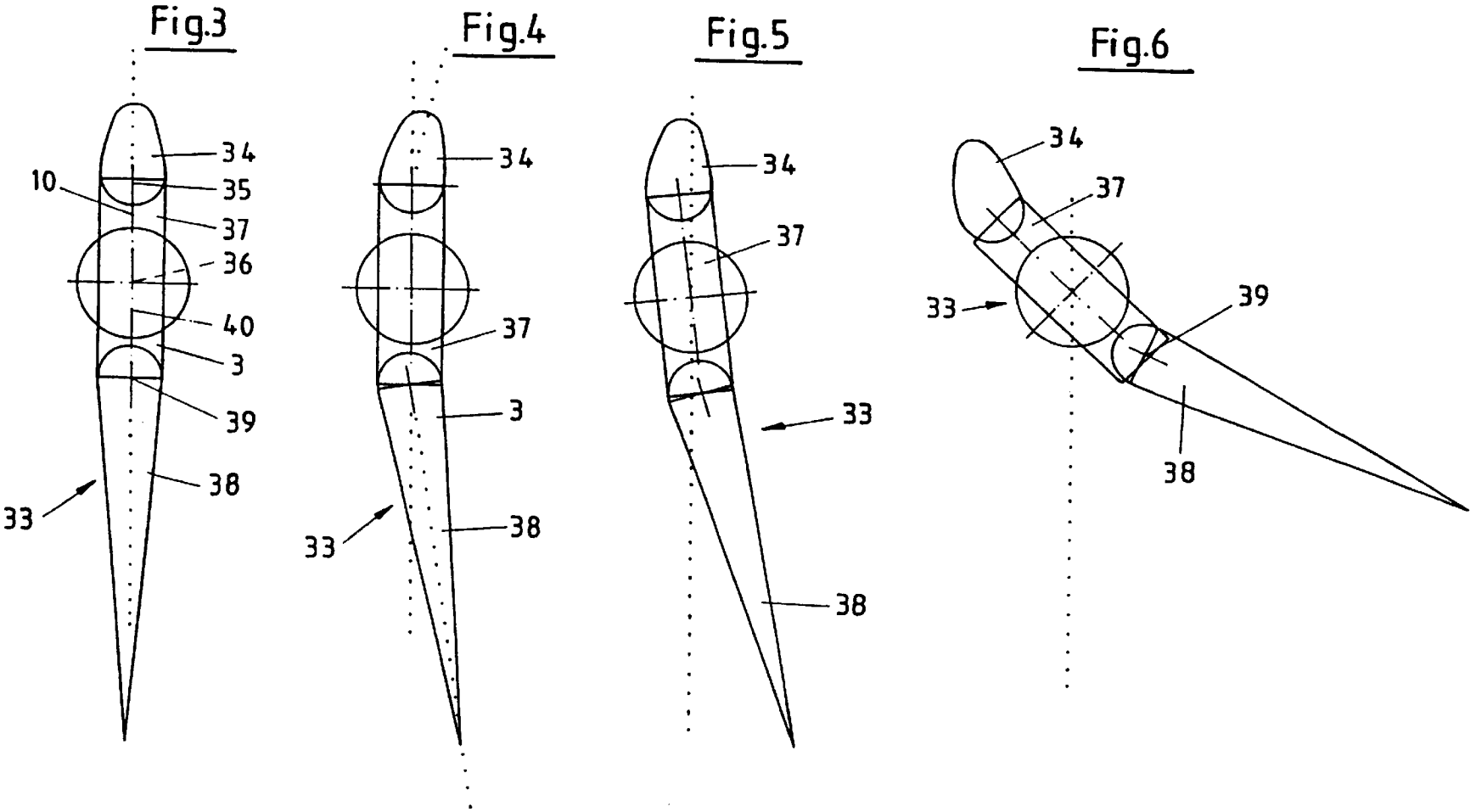
FIG. 3: a triple-section fin keel.
FIG. 4: a different curvature of the above fin keel.
FIG. 5: a further altered profile shape.
FIG. 6: an altered profile shape with a simultaneously adjusted setting angle.

The above-mentioned keel 3 is comprised of three sections, as illustrated in FIGS. 3, 4, 5, and 6, and is referred to as a fin keel 33. As mentioned above, this fin keel 33 is designed such that it can be retracted into or lowered from the hull 2 of the vessel, a feature which is not illustrated here. The individual sections 34, 37, 38 are fastened to one another via hinges 35 and 39, such that they can pivot, so that the curvature of the fin keel 33 can be correspondingly adjusted by bending the individual sections 34, 37, 38 in relation to one another. The center section 37 generally extends along the center line of the boat 10, although, in accordance with FIG. 6, it is also possible to pivot it around the pivoting axis 40, so that the setting angle of the fin keel 33 can be correspondingly adjusted to meet the given conditions. In addition, once the curvature is adjusted, as illustrated in FIG. 6, it can be locked in place, thus ensuring the above-mentioned adjustment of the shape of the fin keel 3 to coordinate with the power from the sail 5. The curvature adjustments and the rotation should be implemented, in accordance with the method specified in the invention, in coordination with the positioning of the sail. The pivoting axis 40 is found at the center of the boat 36.

Figure 7:
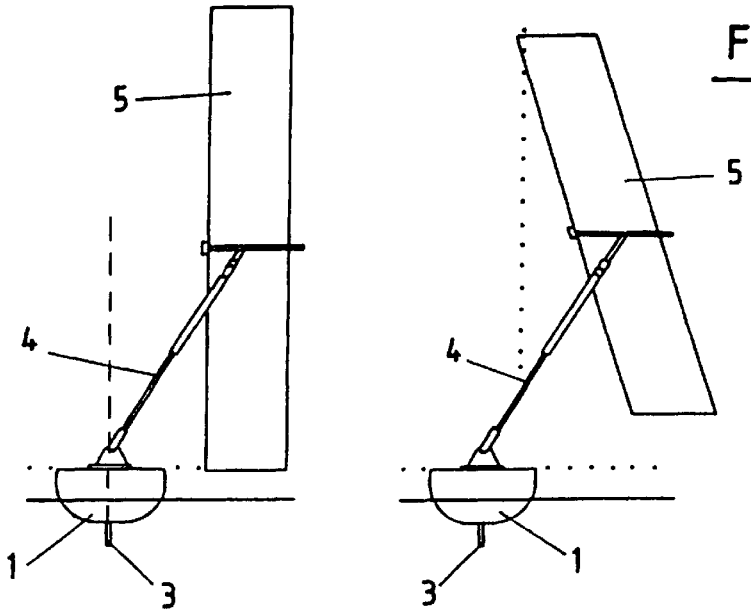
FIG. 7: a sail that is rolled out and pivoted along the pivoting angle.

FIG. 7 shows the unfurling of a certain amount of the sail 5 and the pivoting of the sail 5 along the pivoting angle. This illustration clarifies the ease with which a shifting or adjustment of the sail 5 in this manner, with the special design and the mast arm 4 that is designed to shift lengthwise, can be implemented.

Figure 8:
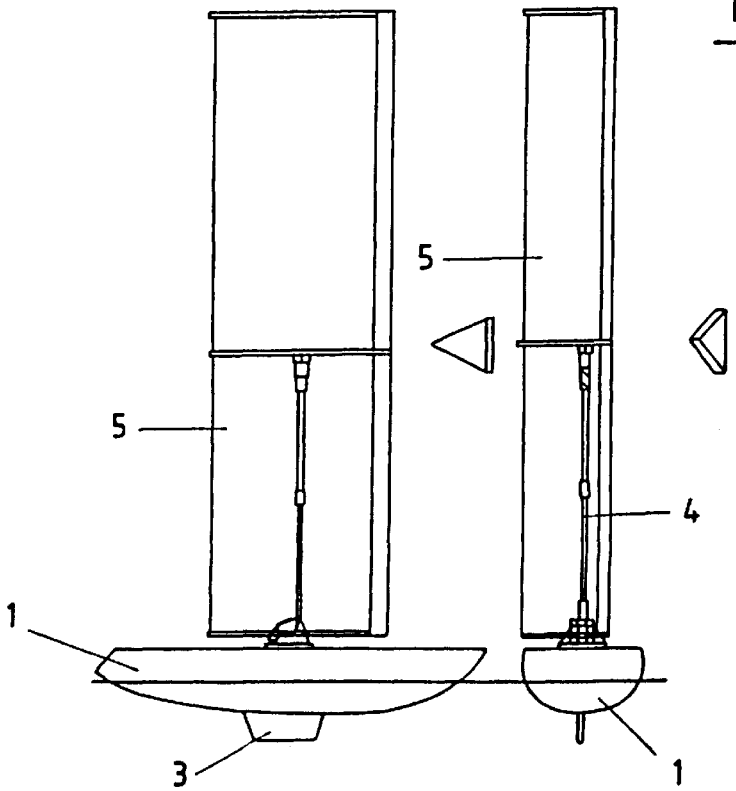
FIG. 8: a boat with its sail positioned for gentle winds.

FIG. 8 illustrates sailing in the wind, with little wind, that is gentle wind. The cantilever 4 in this case is positioned somewhat windward from the center-line plane of the boat. The yard 26 is pivoted vertically, either to 0° or to 180°, depending upon the wind direction. The adjustment to the wind occurs at the optimum angle. The curvature of the sail 5 is increased—to correspond to the gentle wind. Weatherliness and slackness are controlled by tilting slightly the position of the mast arm 4 forward or aft, and the resultant shifting of the center of pressure of the sail (forward or aft of the vertical through the lateral center of pressure 16). This shifting of the center of pressure of the sail could also be used to alter the course of the boat 1.

Figure 9:
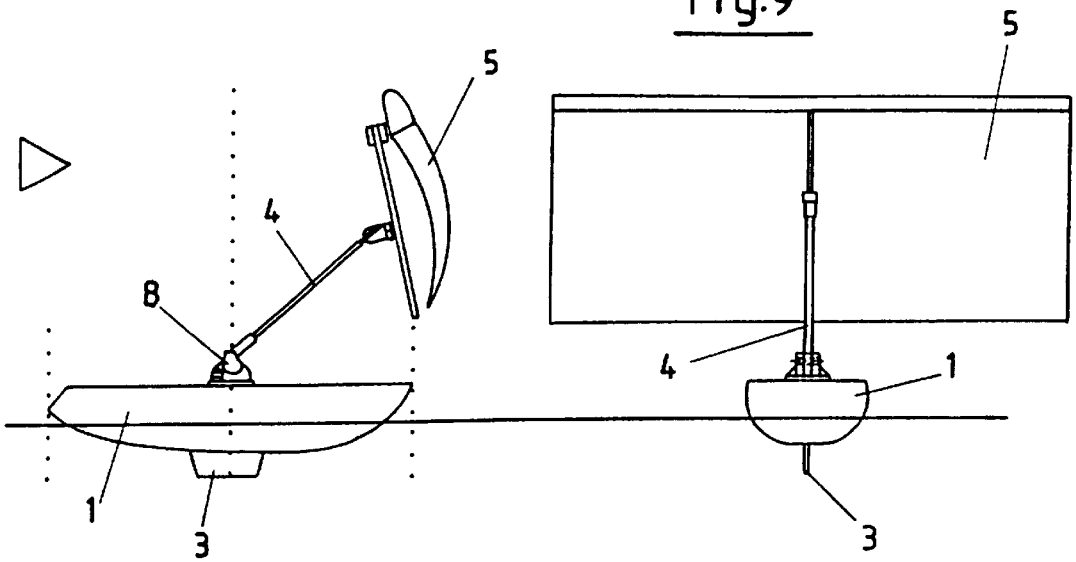
FIG. 9: a boat with its sail positioned as a sky sail.
Figure 10:
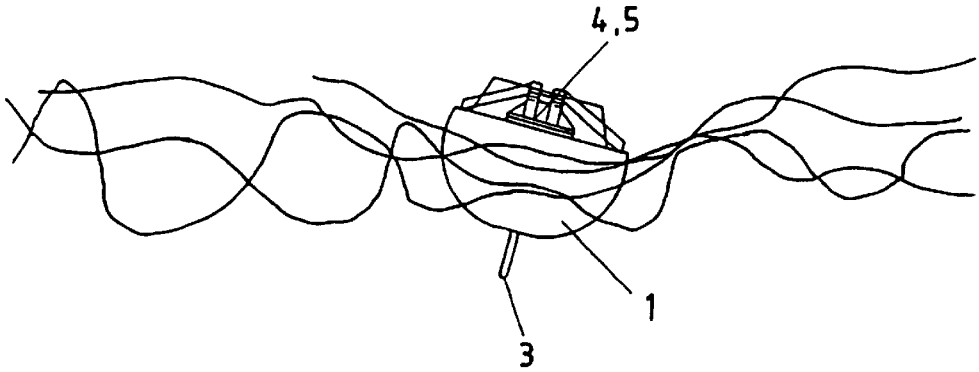
FIG. 10: a sailboat in a hurricane.

With corresponding wind conditions, the mast arm 4 may also be tilted far forward, as is illustrated in FIG. 9. The yard is then turned at right angles to the apparent wind. The setting angle chosen can now be much greater than when sailing by the wind, since the resistance of the sail 5 now also points in the sailing direction of the boat 1. Which setting angle generates the greatest propulsive force can be determined by trial and error.

Under heavy winds and when sailing by the wind, the cantilever is positioned to the lee side, causing the hull of the vessel to be rotated out of the center-line plane. The yard 26 is again positioned at right angles to the apparent wind, but is pivoted far enough that the line of force of the total power 14 generated by the sail 5 is somewhat below the line of the lateral center of pressure 16 in the lateral plane, but is far enough toward the bow from the lateral center of pressure 16 that the now more weatherly moment of the propulsive force is compensated for. The curvature of the sail 5 is flatter—to correspond to the strength of the wind.

If the vessel 1 should be caught on the high seas in a heavy storm or a hurricane, such that a traditional sailing yacht would be in danger of capsizing even with a stripped rigging, the sail 5 and the mast arm 4 can be completely folded down to the boat's deck 9 and locked in place there. This reduces considerably the danger of capsizing. Should the boat nevertheless capsize, for example due to high waves, the folded and fastened sail 5 and mast arm 4 cannot be torn off. Under such extraordinary circumstances the sailing boat 1 will be able to withstand almost any rough seas.

Figure 11:
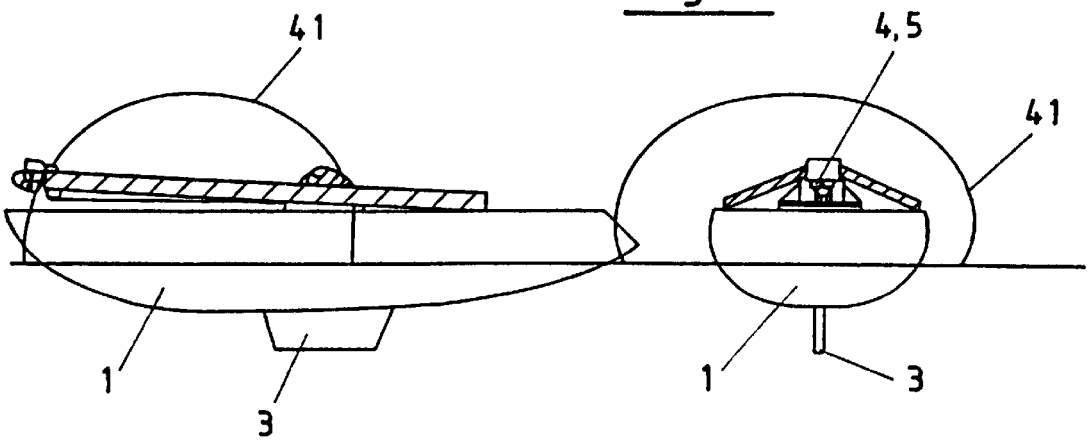
FIG. 11: a sailboat sailing through a bridge underpass.

The option of rapidly and easily folding the mast arm 4 and sail 5 down to the vessel's deck 9 provides the further advantage that with the decreased total height of the "mountings" the boat can be sailed under low, fixed bridges, and is no longer bound by opening times for drawbridges and swing bridges. This is illustrated in FIG. 11, in which a sailing boat 1 is shown sailing through a low-clearance underpass 41.

Figure 12:
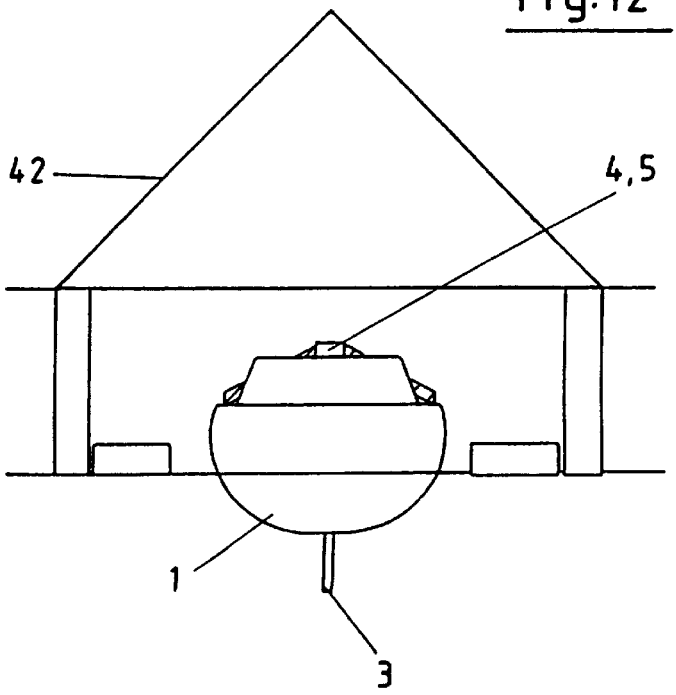
FIG. 12: a sailboat docked in a covered berth.

In addition, due to the special design of the sailing vessel 1 specified in the invention, covered berths or slips 42 can be used, an advantage that will be immediately clear to anyone who has had to remove leaves that have fallen from nearby trees, and flue dust, every weekend—over and over—from their boat, and anyone who has had to repair the damage from break-ins and burglaries. This is illustrated in FIG. 12.

All characterizing features, including those shown only in the diagrams, are considered, alone and in combination, to be essential to the invention.

I claim:

1. Method for low or even non-drift operation of a sailing vessel that is equipped with a fin keel and with a sail that is mounted outside of the center-line plane of the vessel and can be correspondingly positioned in the wind, in which the entire rigging, including the horizontally and vertically pivotable mast arm and the sail, can be moved to and locked into a position that will produce the optimum total power, characterized in that the total power provided by the sail is established, after which the fin keel, which is connected to the sail via a rotating platform and a mast arm, is adjusted in terms of its effective surface and/or its curvature and/or the shape of its profile and/or its setting angle, to coordinate with the position of the sail, such that the total power of the projection generated by the fin keel is directed precisely counter to the total power of the sail on the horizontal plane, while at the same time the ratio of buoyancy to resistance of the fin keel is maximized, while the vessel's hull remains precisely in the sailing direction of the boat.

2. Method in accordance with claim 1, characterized in that the leading edge of the sail is always set at right angles to the apparent wind, and the sail is positioned such that the line of force of the total power of the sail intersects the lateral plane below the lateral center of pressure and/or extends forward or aft or to the side of the lateral plane.

3. Method in accordance with claim 1, characterized in that the keel is automatically adjusted, in terms of the size of its effective surface and/or its setting angle and/or its profile, to correspond to the power from the sail and the relative speed of the current.

4. Sailing vessel having a hull (2) with a keel (3) that can be lowered and a hinged, pivoting mast arm (4), and the sail (5) that is mounted thereon, characterized in that the keel (3) is designed as a multi-section, unballasted fin keel (33) that can be completely retracted into the hull (2) of the vessel and can be pivoted relative to the center line of the vessel (1), and whose sections (34, 37, 38) are fitted together via hinges (35, 39) to produce a variable curvature.

5. Sailing vessel in accordance with claim 4, characterized in that the fin keel (33) or its sections (34, 37, 38) are also designed such that they can be adjusted in terms of the shape of their profile.

6. Sailing vessel in accordance with claim 4, characterized in that the fin keel (33) is mounted to the hull (2) of the vessel or to the rotating platform such that it can pivot up to 90° to any side.

7. Sailing vessel in accordance with claim 4, characterized in that the lateral plane is equipped with two fin keels (33) which are positioned one in front of the other along the center line (10) of the boat, such that they can be lowered and retracted, pivoted, and adjusted in terms of their profile and curvature, independently of one another, wherein one of the two fin keels (33) may be positioned at the center of the boat, but may also be positioned further toward the bow of the vessel.

8. Sailing vessel in accordance with claim 4, characterized in that the fin keel (33) is designed to be in three sections, wherein the center section (37) houses the pivoting axis (40), and the profile tip and the rear fin section (38) are connected to the center section (37) via hinges (35, 39).

9. Sailing vessel in accordance with claim 4, characterized in that the mast arm (4) is designed to be mounted via a flexible joint (8) to the deck (9) of the vessel such that it can pivot horizontally and vertically and can rotate around its longitudinal axis, and such that its length can be adjusted to and locked into any possible position.

10. Sailing vessel in accordance with claim 4, characterized in that the head (21) of the mast arm (4) is equipped with a single-axis, lockable joint (22), to which the main boom (23), containing a pivoting shaft (24) that is positioned inside the main boom such that it can rotate around its longitudinal axis and can be shifted along its longitudinal axis, is attached, and in that the pivoting shaft (24) is equipped with a head piece containing gear works (25) for operating the reef shafts (29) which are housed within the yard (26) and take up the sail cloths (6).

11. Sailing vessel in accordance with claim 10, characterized in that the outer booms (30) that can be locked in place and are equipped with guide pulleys are mounted via hinges to the yard (26).

12. Sailing vessel in accordance with claim 4, characterized in that each joint (8, 22, 27) is equipped with an angle sensor.

13. Sailing vessel in accordance with claim 4, characterized in that the yard (26), which is designed as a profile tip, forms, together with two sails (6) that can be rolled up into the yard (26), a "thick" bearing surface, whose curvature and ratio of length to depth (breadth) may be adjusted.

14. Sailing vessel in accordance with claim 4, characterized in that one reef shaft (29) takes up two sail cloths (6) which are fastened to the trailing edge of the yard (26) via a plate that is positioned at right angles to the sail cloths (6) and has rounded edges.

15. Sailing vessel in accordance with claim 4, characterized in that the sail cloths (6) can be rolled up and rolled out individually.

* * * * *